US009933234B1

(12) United States Patent
Shows

(10) Patent No.: US 9,933,234 B1
(45) Date of Patent: Apr. 3, 2018

(54) FIREARM COVER ATTACHABLE TO A HOLSTER

(71) Applicant: Luke N Shows, Cantonment, FL (US)

(72) Inventor: Luke N Shows, Cantonment, FL (US)

( * ) Notice: Subject to any disclaimer, the term of this patent is extended or adjusted under 35 U.S.C. 154(b) by 1 day.

(21) Appl. No.: 15/252,337

(22) Filed: Aug. 31, 2016

(51) Int. Cl.
*F41A 35/02* (2006.01)
*F41C 33/04* (2006.01)
*F41C 33/02* (2006.01)

(52) U.S. Cl.
CPC ..... *F41C 33/0218* (2013.01); *F41A 35/02* (2013.01); *A45F 2200/0591* (2013.01); *F41C 33/04* (2013.01)

(58) Field of Classification Search
CPC ... F41A 35/02; F41C 33/04; A45F 2200/0591
See application file for complete search history.

(56) References Cited

U.S. PATENT DOCUMENTS

D28,239 S * 2/1898 Millhiser ..... D27/185
668,382 A 2/1901 Martin
2,455,635 A 12/1948 Witte
3,688,953 A 9/1972 Bianchi
4,325,505 A 4/1982 Hillman
4,475,675 A 10/1984 Miles
4,848,366 A * 7/1989 Aita ..... A41D 13/1192 128/206.24
4,858,361 A 8/1989 White
4,860,479 A * 8/1989 Easter ..... F41A 35/02 206/317
5,048,217 A * 9/1991 Easter ..... F41A 35/02 42/96
5,233,978 A * 8/1993 Callaway ..... A61M 16/06 128/205.25
5,513,621 A * 5/1996 Vanskiver ..... F41B 5/1457 124/86
5,778,590 A 7/1998 Browning et al.
6,145,504 A * 11/2000 Miyake ..... A41D 13/11 128/206.19
6,164,004 A * 12/2000 Essary ..... F41A 35/02 42/96
6,176,408 B1 * 1/2001 Miner ..... A42B 3/006 224/153
6,564,498 B2 * 5/2003 Sawtell ..... A01K 89/00 150/154
D584,054 S * 1/2009 Massie ..... D3/244
7,520,673 B2 * 4/2009 Bonke ..... B65F 1/0006 220/495.11
7,757,421 B1 * 7/2010 Tompkins ..... F41A 35/04 206/317

(Continued)

*Primary Examiner* — Justin Larson
(74) *Attorney, Agent, or Firm* — Peter Loffler

(57) ABSTRACT

A cover for use with a firearm holster uses a main pocket that has an open top and a pair of strings, which may be elasticized, which string each extend from the open top on either side of this pocket. Each string is attached to a clip of the holster and the main pocket is positioned over the exposed handle end of a firearm that is received within the holster as well as a portion of the holster. The main pocket, which may be multilayered, acts as a barrier between a user's skin and the exposed end of the firearm and its holster in order to prevent skin chafing and discomfort that can be caused by the exposed end of the firearm and its holster rubbing against the user.

10 Claims, 4 Drawing Sheets

(56) References Cited

U.S. PATENT DOCUMENTS 7,837,032 B2 * 11/2010 Smeltzer ..... A63B 55/00 150/117
7,845,351 B2 * 12/2010 Mathis ..... A41D 13/11 128/205.27
7,854,210 B2 * 12/2010 Moore ..... A41H 43/04 112/475.09
D640,768 S 6/2011 Boggan et al.
D641,548 S 7/2011 Zusman
8,091,550 B2 * 1/2012 Steindorf ..... A41D 13/11 128/205.27
D655,504 S * 3/2012 Barlier ..... D3/303
8,302,827 B1 11/2012 Cole
8,517,235 B1 8/2013 Kincaid et al.
8,800,563 B2 * 8/2014 Doherty ..... A61M 16/0683 128/205.25
8,939,138 B2 * 1/2015 Arajakis ..... F41C 23/02 124/87
9,297,612 B2 3/2016 Schmadeka
9,310,158 B2 * 4/2016 Jones ..... F41B 5/1461
9,360,275 B2 * 6/2016 de Nijs ..... F41C 33/04
D777,287 S * 1/2017 Scott ..... D22/108
D777,288 S * 1/2017 Scott ..... D22/108
2005/0279789 A1 * 12/2005 Lowe ..... F41C 33/0209 224/244
2005/0284459 A1 * 12/2005 Anderson ..... F41G 1/467 124/90
2006/0006634 A1 * 1/2006 Packer ..... A63C 11/027 280/809
2006/0144404 A1 * 7/2006 Callan ..... A41D 13/11 128/206.19
2006/0283454 A1 * 12/2006 Delaney ..... A41D 13/1161 128/206.19
2007/0175787 A1 * 8/2007 Lown ..... A45F 3/16 206/427
2010/0236954 A1 * 9/2010 Brown ..... A45C 11/00 206/315.9
2012/0091175 A1 4/2012 de Nijs
2012/0111309 A1 * 5/2012 Parks ..... F41B 5/1457 124/88
2013/0068355 A1 * 3/2013 Levy ..... A45C 3/08 150/105
2013/0105049 A1 * 5/2013 Ebersole ..... F41B 5/148 150/154
2013/0175309 A1 7/2013 King
2013/0320055 A1 12/2013 King
2014/0182754 A1 * 7/2014 Young ..... A45F 5/02 150/154
2015/0041513 A1 2/2015 Hawks, Jr.
2015/0090749 A1 * 4/2015 Moreau ..... A45F 5/00 224/191
2015/0246751 A1 * 9/2015 Spivack ..... B65D 31/12 224/411
2015/0351571 A1 * 12/2015 Johnson ..... A45F 5/00 224/250
2016/0153748 A1 6/2016 Tedder

* cited by examiner

FIREARM COVER ATTACHABLE TO A HOLSTER

BACKGROUND OF THE INVENTION

1. Field of the Invention

The present invention relates to a removable cover that is positioned over the exposed end of a holstered handgun in order to provide a barrier between the exposed portion of the handgun and a person carrying the handgun in either an inside the waistband or outside the waistband position.

2. Background of the Prior Art

As the world becomes more complex, and is perceived to be more dangerous, more and more people are learning to use firearms, especially handguns, for self-defense. Coupled with such firearm proficiency, people, both men and women, in record numbers are applying for, and receiving concealed carry permits that allow the holders of such permits to carry firearms and other weapons on their person in a concealed manner. One of the concealed carry methods preferred by many, especially by men but also by many women, is to position the firearm about the waistband of a person's pants. The firearm, which is typically holstered in appropriate fashion, is positioned either inside the waistband of the person's pants or outside the waistband of the person's pants, clipped via the holster to either the waistband proper of the pants or to a belt being worn in conjunction with the pants. A shirt or other type of torso cover overlays the firearm so positioned in order to conceal the firearm from view of others. Most often, the holstered firearm is positioned proximate the person's hip, but is occasionally located proximate the small of the person's back or up front just below the person's bellybutton. This method of concealed carry is relatively conformable and provides fast and easy access to the firearm in case of emergency.

While an effective concealed carry position, waistband placement of the firearm has a major drawback in that in order to conceal the firearm, the person's shirt or other type of torso cover is, by necessity, placed in covering relationship with the firearm so that the exposed portion of the firearm, the portion not within the holster, presses up against the person's skin. Over time, as the person goes about his or her business, the firearm and its holster rub against the skin, sometimes leading to chaffing of the skin, all of which is quite uncomfortable. For some, depending on placement of the holstered firearm and the firearm's cant, the firearm may also dig into the person's pelvis, exacerbating the discomfort. If the person sweats while carrying the firearm, the sweat transfers to the firearm requiring frequent cleaning of the firearm in order to prevent damage thereto. Additionally, such sweat creates the need to replace the ammunition within the firearm for fear of the sweat and the oils carried thereby, leaching into the ammunition which can result in disabling of the ammunition.

To combat this problem, some waistband position concealed carriers put on a base garment, such as an undershirt, that is positioned between the person's skin and the firearm. This base garment helps prevent chafing of the person's skin that would otherwise be caused by the exposed handle end of the firearm and the back of the holster. While reasonably effective, this solution is not without its drawbacks. If the temperature is warm, such as during summer months or in southern climates, a base garment, even a relatively thin garment, is uncomfortable to the wearer and creates additional sweat. As such, the concealed carrier is exchanging one form of discomfort for another. Additionally, if the person wearing the base garment is relatively active, the base garment can ride up the person's torso, often settling back so as to be positioned over the firearm, that is between the firearm and the outer garment, instead of between the firearm and the person's skin, resulting in the need for awkward repositioning of the base garment.

What is needed is a device that increases the overall comfort to a person carrying a concealed firearm in an inside the waistband or outside the waistband manner, which device addresses the above stated shortcomings found in the art. Such a device must act as a barrier between the exposed portion of the firearm and the back of the holster and the person's skin without the need for the person to wear additional clothing with the attendant problem of being uncomfortably warm. Such a device must stay properly positioned even if the user is physically active during device usage. Such a device should be of relatively simply design and be easy to use without unnecessarily inhibiting access to the firearm.

SUMMARY OF THE INVENTION

The firearm cover attachable to a holster of the present invention addresses the aforementioned needs in the art by providing a device that acts as a barrier between the exposed portion of a firearm—that portion of the firearm not within or backed by a holster—as well as the holster itself and a person's skin whenever the person is carrying the firearm in an inside the waistband or outside the waistband manner. The firearm cover attachable to a holster eliminates the need for the person to don a base garment to provide such a barrier yet helps prevent the transfer of sweat and oils from the user's skin to the firearm. The firearm cover attachable to a holster is of relatively simple design and construction, being produced using standard manufacturing techniques, so as to make the device relatively inexpensive to produce so as to make the device relatively economical for potential consumers of this type of device. The firearm cover attachable to a holster is easy to use and does not require readjustment if the user is physically active while deploying the device. The firearm cover attachable to a holster is easy to install and does not unnecessarily inhibit access to the firearm if needed yet provides secondary concealment of the firearm if the user's outer garment inadvertently rides up over the firearm.

The firearm cover attachable to a holster of the present invention is comprised of a main pocket that has a pair of main panels joined at a bottom and along a pair of opposing side edges. The main pocket also has an open top and may be made from an elasticized material. A pair of strings is provided and each extends from the open top at a respective one of the side edges. Each string is attached to one of the clips of a firearm holster or to the only clip in the case of a single clip holster design. A firearm is positioned within the firearm receiver of the holster and the main pocket is positioned over an exposed handle end of the firearm. Each string may be elasticized. A top edge of the main pocket at the open top has piping therealong which piping may be elasticized. At least one of the main panels may be made from a first layer of material and a second layer of material wherein the first layer of material is distinct from the second layer of material. Such material may include moisture absorbent material, moisture impervious material, or a resilient cushioning material. An optional second pocket has an opening may be attached to an outer surface of one of the main panels, the second pocket holding a magazine for use with the firearm. The opening of the second pocket faces one of the side edges of the main pocket or it may face in the direction of the bottom of the main pocket.

BRIEF DESCRIPTION OF THE DRAWINGS

Similar reference numerals refer to similar parts throughout the several views of the drawings.

DESCRIPTION OF THE PREFERRED EMBODIMENT

Figure 1:
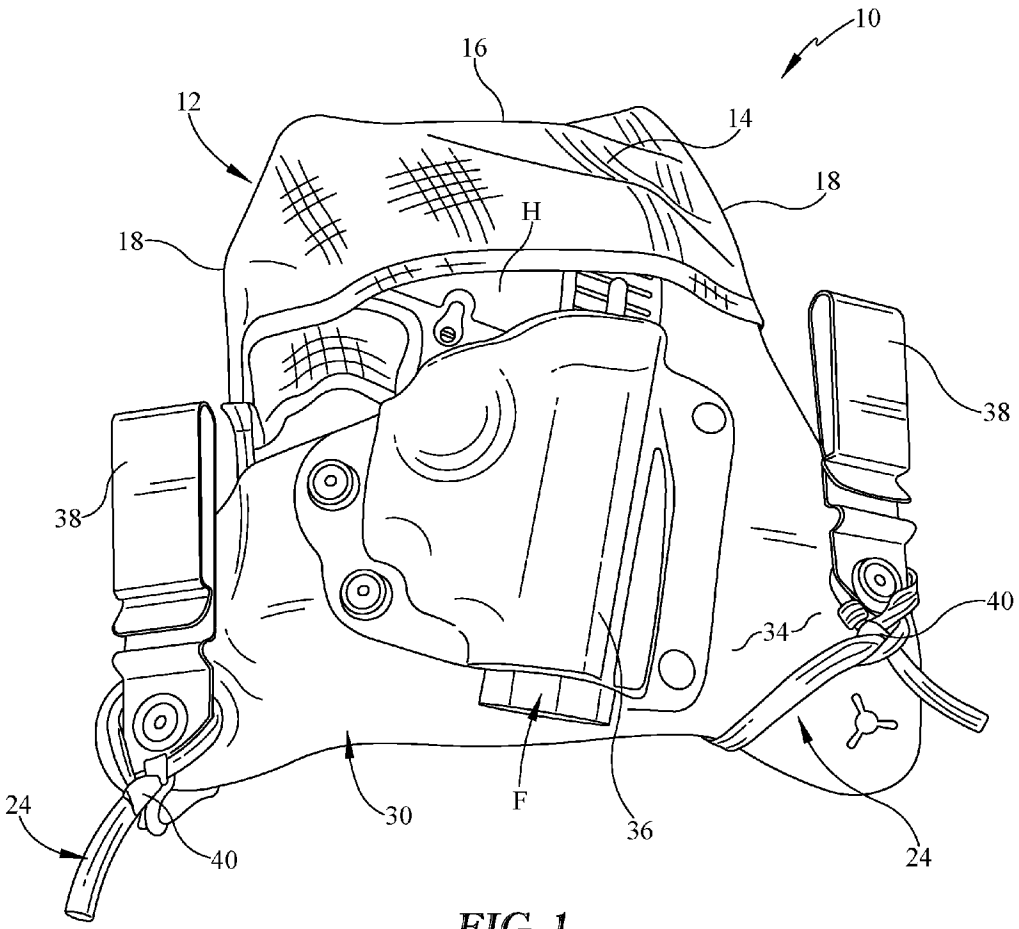
FIG. 1 is front environmental view of the firearm cover attachable to a holster of the present invention.
Figure 2:
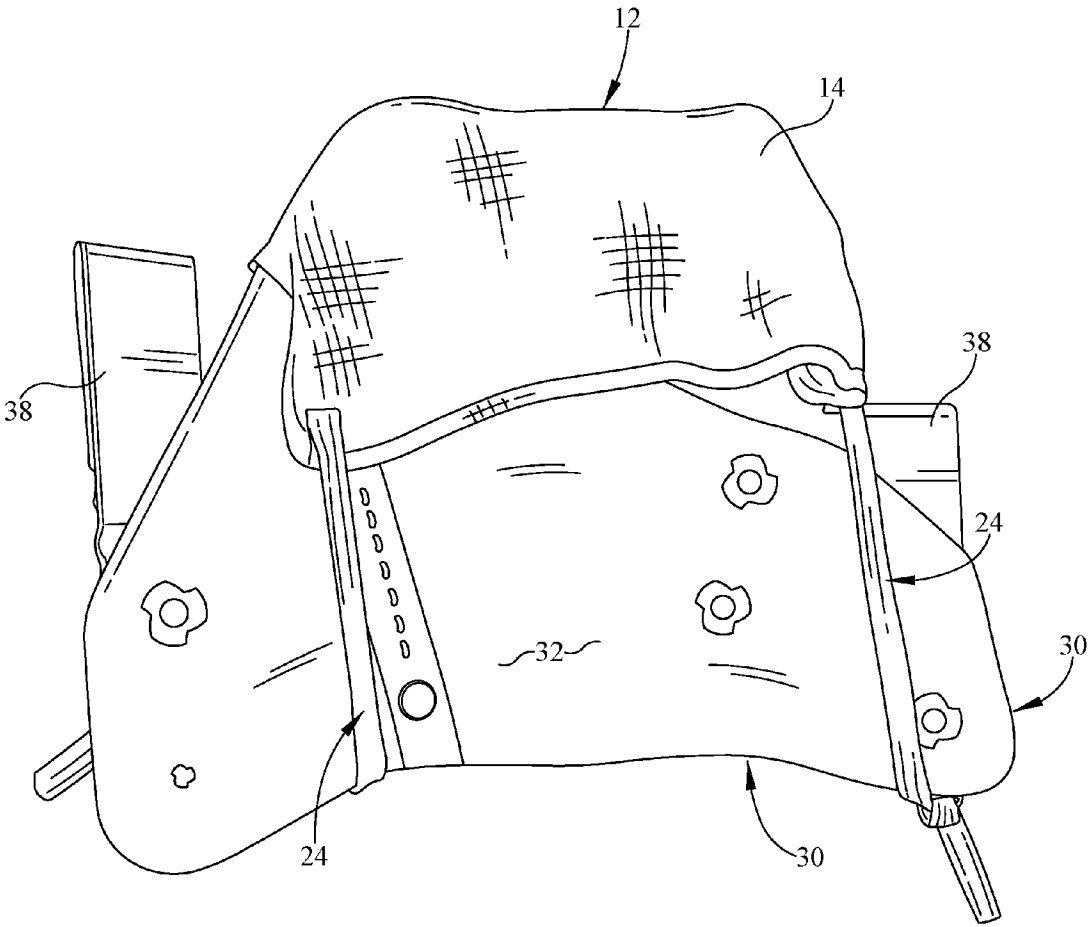
FIG. 2 is a rear environmental view of the firearm cover attachable to a holster.
Figure 3:
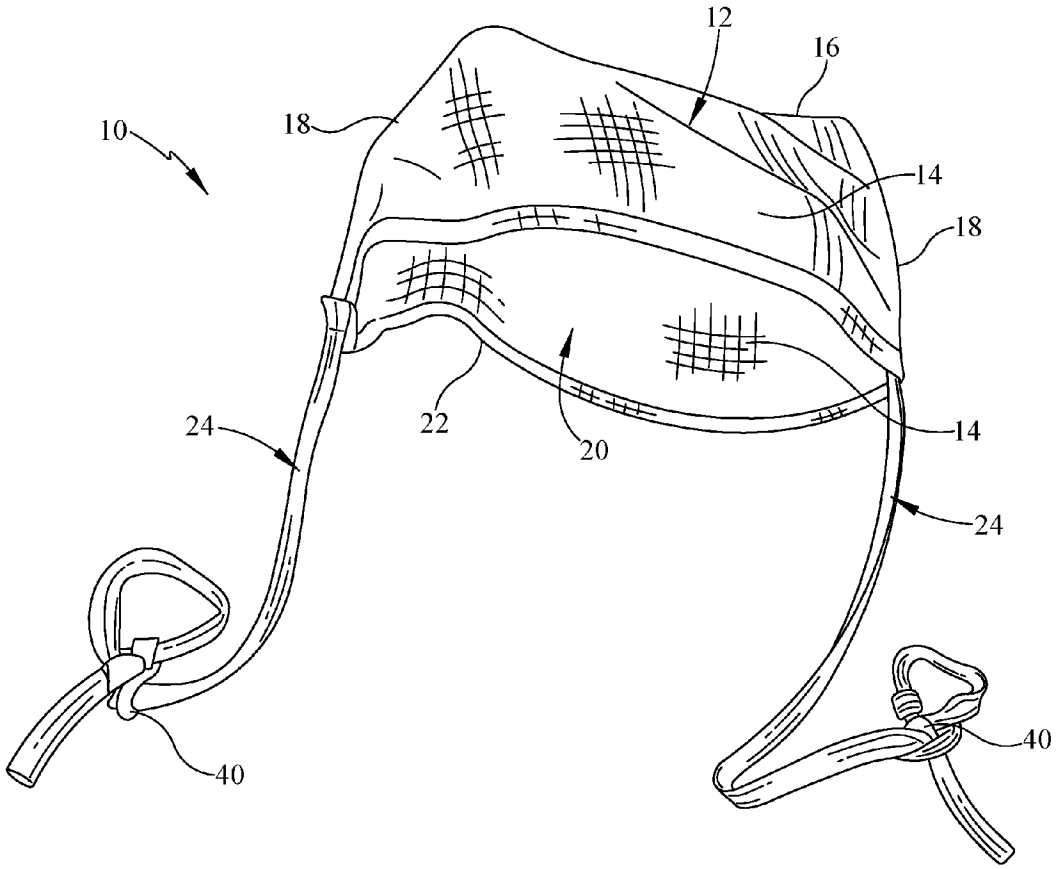
FIG. 3 is a perspective view of the firearm cover attachable to a holster.

Referring now to the drawings, it is seen that the firearm cover attachable to a holster of the present invention, generally denoted by reference numeral 10, is comprised of pocket or hood 12 that has a pair of main panels 14, joined at a bottom 16 (the two main panels 14 may be formed from a single piece of material) and at a pair of side edges 18, the main pocket 12 also has an open top 20. The open top 20 may have piping 22, which may be elasticized, or otherwise be hemmed or selvaged in appropriate fashion. The hood 12 can be made from any appropriate material such as cotton, cotton blend, terrycloth, polyester, silk, bamboo, etc., and may be elasticized The main panels 14 of the main pocket 12 may be formed as a single layer of the just mentioned material or may have one or more additional layers (none illustrated) for added functionality. For example, the inner surface of the one or both main panels 14 of the main pocket 12 may be lined with an appropriate grip material, such as a gooey material, which can include rubber, neoprene, etc. Additionally, the inner surface of one or both main panels 14 of the main pocket 12 or the outer surface of one or both main panels of the main pocket 12 may have either a moisture absorption layer or a moisture impervious layer, or both thereon. Further, the inner surface of one or both main panels 14 of the main pocket 12 or the outer surface of one or both main panels 14 of the main pocket 12 may have a soft resilient layer, such as foam (this layer may act as a moisture absorption layer). Each main panel of the main pocket 12 may be more than two layers thick, for example, having one or both main panels may have layered with a resilient layer and a moisture impervious layer. Of course, the main panel proper may be made from one of these layer materials.

Extending from each side edge 18 of the main pocket 12 from the open top 20 is a string 24. Each string 24 may be elasticized.

Figure 4:
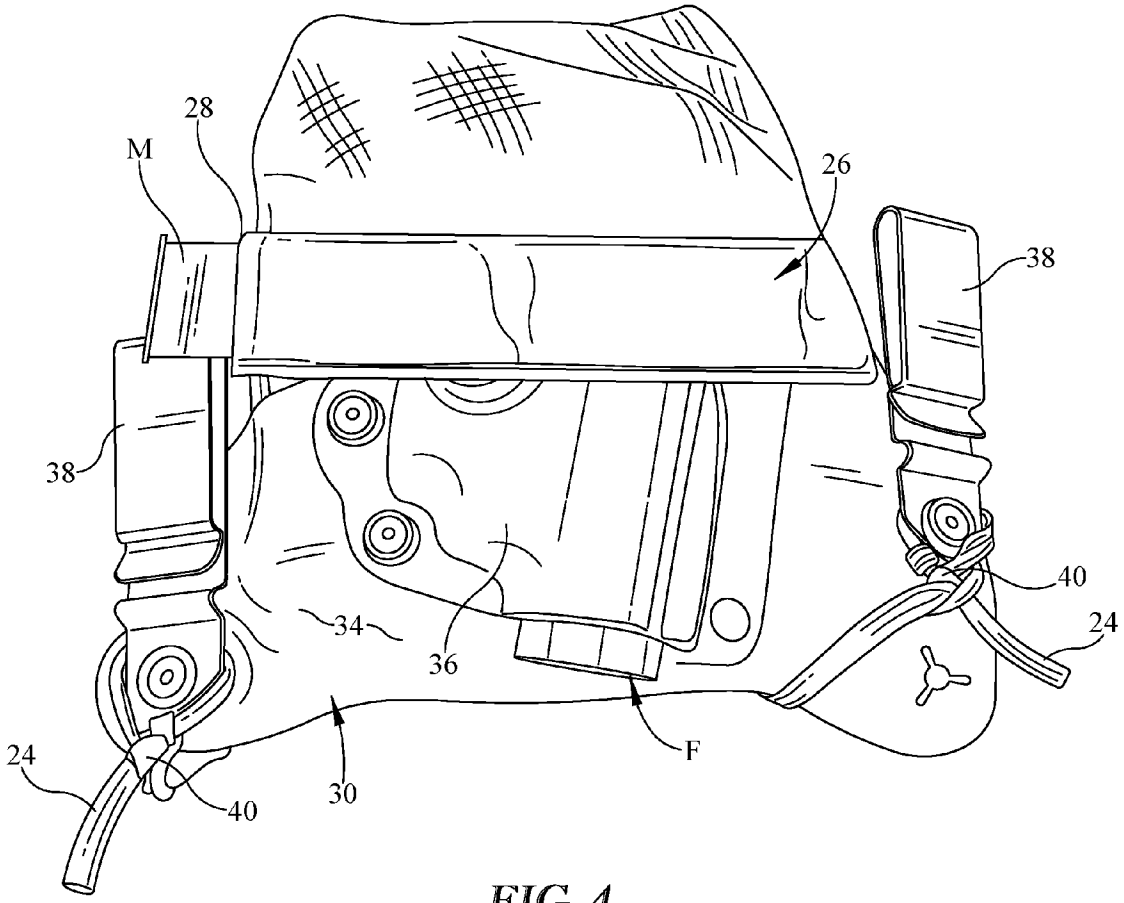
FIG. 4 is an environmental view of the firearm cover attachable to a holster with an optional magazine pocket.

As seen in FIG. 4, an optional second pocket 26 may be located on the outer surface of one of the main panels 14 of the main pocket 12. This second pocket 26 is relatively long and narrow and has an opening 28 that faces generally toward one of the side edges 18 or may be angled slightly toward the bottom 16 of the main pocket 12 or may face in the direction of the bottom 16 of the main pocket 12 depending on the type of holster with which the firearm cover attachable to a holster 10 is to be used with. This second pocket 26 is made from the same or similar material used to form the main pocket 12 and may also have the above-described layering.

In order to use the firearm cover attachable to a holster 10 of the present invention, a firearm holster 30 of appropriate design is provided. The holster 30 may be an inside the waistband type of holster as illustrated or an outside the waistband holster. As seen, the holster 30 has a first surface 32 and a second surface 34 which has a firearm receiver 36 thereon to removably receive a firearm F therein. One or more clips 38 are located on the holster 30, typically on the second surface 34 of the holster 30, but may be located on the first surface 32 of the holster 30. The clips 38 are used to attach the holster 30 to the waistband or belt being worn by a user. With the firearm F holstered within the firearm receiver 36, the main pocket 12 is positioned overtop the exposed handle end H of the firearm F. Each string 24 is attached to the holster 30 by attaching each string 24 to one of the clips 38 or to the only clip in a one clip holster design. A knot 40 may be made on each string 24 for ease of subsequent use of the firearm cover attachable to a holster 10. Advantageously, each string 24 passes along the first surface 32 of the holster 30 so as not to pass over or near the holstered firearm F. The user can now clip the holster 30 to his or her waistband or belt in appropriate fashion. The main pocket 12 is positioned between the handle end H of the firearm F and the person's exposed skin proximate the site of the holster 30 placement and helps prevent chafing or other discomforts caused by the handle end H of firearm F to skin contact. If the main panel 14 that is pressing against the user's skin has additional layers, these additional layers increase the usefulness of the device. For example, if the main panel 14 has a resilient layer and a moisture impervious layer, then the two layers help cushion the handle end's contact against the skin and absorb excess sweat that may form thereat, as well as prevent the sweat from passing through to the firearm F.

If access to the firearm F is needed, the main pocket 12 is removed from the handle end H of the firearm F and the firearm F is unholstered in standard fashion. Once the firearm F is reholstered, the main pocket 12 can once again be placed onto the handle end H of the firearm F. If the strings 24 are elasticized, then such elasticization helps maintain the main pocket 12 on the handle end H of the firearm F. The firearm cover attachable to a holster 10 also helps cover the firearm F in the event that the covering torso top of the user inadvertently lifts up to expose the holster 30 and firearm F.

If the firearm cover attachable to a holster 10 has a second pocket 26, a magazine M to be used with the firearm F is removably received within the second pocket 26 and removed therefrom as needed While the invention has been particularly shown and described with reference to an embodiment thereof, it will be appreciated by those skilled in the art that various changes in form and detail may be made without departing from the spirit and scope of the invention.

I claim:

1. A cover in combination with a firearm holster having a body member that has a firearm receiver that removably receives a firearm therein and at least one clip attached thereto, comprising:

a main pocket having a pair of main panels joined at a bottom and along a pair of opposing side edges, the main pocket having an open top;

a pair of strings, each string extending from the open top at a respective one of the side edges, such that each string is attached to the at least one clip of the firearm holster; and wherein when a firearm is disposed within the firearm receiver of the holster, the main pocket is positioned over an exposed handle end of the firearm.

2. The cover as in claim 1 wherein each string is elasticized.

3. The cover as in claim 1 wherein a top edge of the main pocket at the open top has piping therealong.

4. The cover as in claim 3 wherein the piping is elasticized.

5. The cover as in claim 1 wherein at least one of the main panels is made from a first layer of material and a second layer of material wherein the first layer of material is distinct from the second layer of material.

6. The cover as in claim 5 wherein the first layer of material is a moisture absorbent material.

7. The cover as in claim 5 wherein the first layer of material is a moisture impervious material.

8. The cover as in claim 5 wherein the first layer of material is a resilient cushioning material.

9. The cover as in claim 1 further comprising a second pocket having an opening, the second pocket attached to an outer surface of one of the main panels.

10. The cover as in claim 1 wherein the main pocket is made from an elasticized material.

* * * * *